United States Patent [19]

Shinto et al.

[11] 4,319,497

[45] Mar. 16, 1982

[54] DEVICE FOR TURNING OVER A CLUTCH PEDAL

[75] Inventors: Hiroaki Shinto, Toyota; Shigemichi Yamada, Aichi, both of Japan

[73] Assignee: Toyota Jidosha Kogya Kabushiki Kaisha, Aichi, Japan

[21] Appl. No.: 128,449

[22] Filed: Mar. 10, 1980

[30] Foreign Application Priority Data

Sep. 17, 1979 [JP] Japan ..... 54-128961[U]

[51] Int. Cl.[3] ..... G05G 1/14

[52] U.S. Cl. ..... 74/512

[58] Field of Search ..... 74/512, 516, 518

[56] References Cited

U.S. PATENT DOCUMENTS 2,621,538 12/1952 Bechman et al. ..... 74/512

3,014,381 12/1961 Frank ..... 74/512

FOREIGN PATENT DOCUMENTS 52-33226 3/1977 Japan ..... 74/512

*Primary Examiner*—Kenneth Dorner

*Attorney, Agent, or Firm*—Oblon, Fisher, Spivak, McClelland & Maier

[57] ABSTRACT

Disclosed herein is a device for turning over a clutch pedal which comprises an arm for turning the clutch pedal over, a rod connecting the arm to the clutch pedal for joint rotation upon working of the clutch pedal and a tension spring provided between the arm and the clutch pedal. When the clutch pedal is worked until it reaches a predetermined position, the direction of force of the tension spring acting on the clutch pedal for returning it to its initial position is changed to assist forward movement of the clutch pedal. The device further includes a means connected to the rod for applying lateral force to the rod.

3 Claims, 4 Drawing Figures

DEVICE FOR TURNING OVER A CLUTCH PEDAL

BACKGROUND OF THE INVENTION

1. Field of the Invention

The present invention relates to a clutch pedal of a friction clutch for an automobile, and more particularly, to a device for turning the clutch pedal over for reducing the force for working the clutch pedal.

2. Description of the Prior Art

A conventional turnover device comprises an arm for turning the clutch pedal over which is jointly rotatably connected to the clutch pedal by a rod or a lever and a tension spring provided between the arm and the clutch pedal. When the clutch pedal is worked until it reaches a predetermined position, the force of the tension spring acting on the clutch pedal to return it to its initial position is changed to assist forward movement of the clutch pedal, and thereby reduce the force for working the same.

In a position at which the tension spring changes the direction of force acting on the rod, i.e., a turnover point, the direction of the force acting upon the portions connecting the rod with the clutch pedal and the arm is changed. The aforementioned parts are pivotally connected with each other by, for example, engagement of pins and pin holes, and in general, a clearance is defined between each of the pins and the pin holes to allow each other's relative rotation. On account of this, when the direction of the force acting on the rod is changed at the turnover point by rapid movement of the clutch pedal, a knocking sound is generated in either of the connecting portions, the impact of which will exert a bad influence upon operational feeling of the clutch pedal.

Even when a bush is interposed between the pin and the pin hole, a clearance will more or less be created, and granted that the pin and the pin hole are completely fitted with no clearance defined, abrasion of the bush will inevitably create a clearance.

SUMMARY OF THE INVENTION

The object of the present invention is to overcome the aforementioned disadvantage of the prior art providing a device for turning over a clutch pedal which can prevent generation of knocking sounds in connecting portions between the clutch pedal and a rod and between the rod and a rotatable arm at a turnover point into which the clutch pedal is worked and further prevent bad influence upon the pedal feeling by impact with which the knocking sounds are accompanied.

According to the present invention, there is provided a device for turning over a clutch pedal which can prevent generation of knocking sounds following abrupt relative displacement in connecting portions between the clutch pedal and a rod and between the rod and a rotable arm by providing lateral force which acts upon the rod at the intermediate portion between the aforementioned connecting portions substantially perpendicularly to the axis of the rod so that members forming the connecting portions are displaced relatively to each other within clearances defined therebetween continuously keeping in sliding contact with each other when the direction of force acting on the rod is changed at a turnover point and further prevent bad influence upon the pedal feeling by an impact which is accompanied with the knocking sounds.

DESCRIPTION OF THE PREFERRED EMBODIMENT

Figure 1:
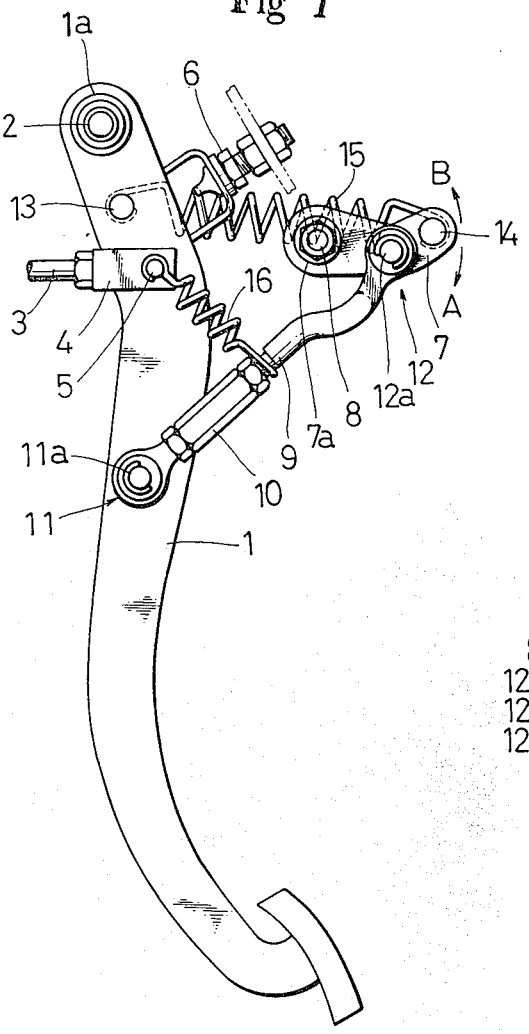
FIG. 1 is a front elevational view of a clutch pedal to which the device according to the present invention is applied.
Figure 2:
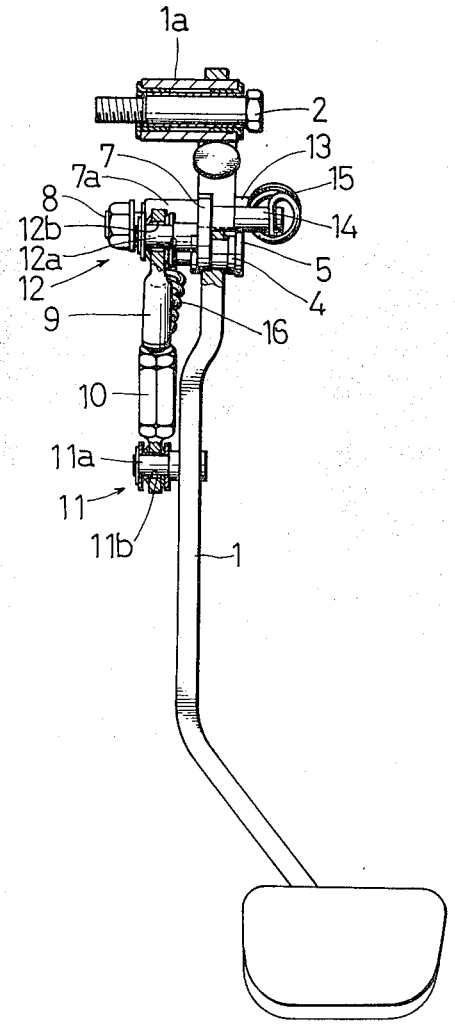
FIG. 2 is a partially fragmentary rear elevational view of the clutch pedal as viewed from right-hand direction in FIG. 1.

Referring now to FIGS. 1 and 2 of the drawings, there is shown a clutch pedal 1 of a vehicle, of which pedal boss 1*a* is rotatably mounted to a pedal shaft 2 which is secured to a pedal bracket in the vehicle body (not shown). The clutch pedal 1 is connected by a clevis pin 5 to a clevis 4 which is, in turn, connected to a push rod 3 of a clutch master cylinder (not shown).

An arm 7 for turning the clutch pedal 1 over is rotatably mounted to a part of the body member rearwardly of the clutch pedal 1, i.e., in the right hand side in FIG. 1. A boss 7*a* provided in one end of the arm 7 is mounted rotatably along an arm shaft 8 which is secured to the body member. The arm 7 is connected substantially at its middle portion to a portion of the clutch pedal 1 by a rod 9. A member 11 connecting the rod 9 to the clutch pedal 1 comprises a pin 11*a* projecting integrally from the clutch pedal 1 and a pivot hole (not shown) formed in one end of the rod 9 which are rotatable relative to each other and a bush 11*b* interposed therebetween (see FIG. 2). In like manner, a member 12 connecting the rod 9 to the arm 7 comprises a pin 12*a* projecting integrally from the arm 7 and a pivot hole (not shown) formed in the other end of the rod 9 which are rotatable relative to each other and a bush 12*b* interposed therebetween (FIG. 2). Since the arm 7 is thus connected by the rod 9 to the clutch pedal 1, the arm 7 is rotated along the arm shaft 8 in the direction of an arrow A in FIG. 1 when the clutch pedal 1 is worked. The rod 9 is divided into two parts with respect to its longitudinal direction, the axial length of which is adjustable by a turnbuckle 10.

A pin 13 extends integrally from the clutch pedal 1 between the clevis pin 4 and the pedal shaft 2, and a tension spring 15 is provided between the pin 13 and another pin 14 extending integrally from the free end of the arm 7. When the clutch pedal 7 is in a return position and kept in contact with a pedal stopper 6 as shown in FIG. 1, a line connecting the two pins 13 and 14, i.e., the axis of the tension spring 15, is located above the arm shaft 8 along which the arm 7 is rotated.

Between the clevis pin 5 of the clutch pedal 1 and the rod 9, there is provided another tension spring 16 which is smaller in spring constant than the aforementioned tension spring 15. The tension spring 16 is engaged with the rod 9 at the intermediate portion between the connecting members 11 and 12, and further, arranged to apply tensile force against the rod 9 substantially perpendicularly to its axis when the clutch pedal 1 is worked until it reaches a turnover point as hereinafter described.

When the clutch pedal 1 is in the return position as shown in FIG. 1, the tensile force of the tension spring 15 provided between the pin 13 of the clutch pedal 1 and the pin 14 of the arm 7 acts upon the arm 7 to rotate the same in the direction of an arrow B in FIG. 1 along the arm shaft 8. By virtue of the moment of rotation of the arm 7 and the tensile force of the spring 15, the clutch pedal is maintained in the return position.

Figure 3:
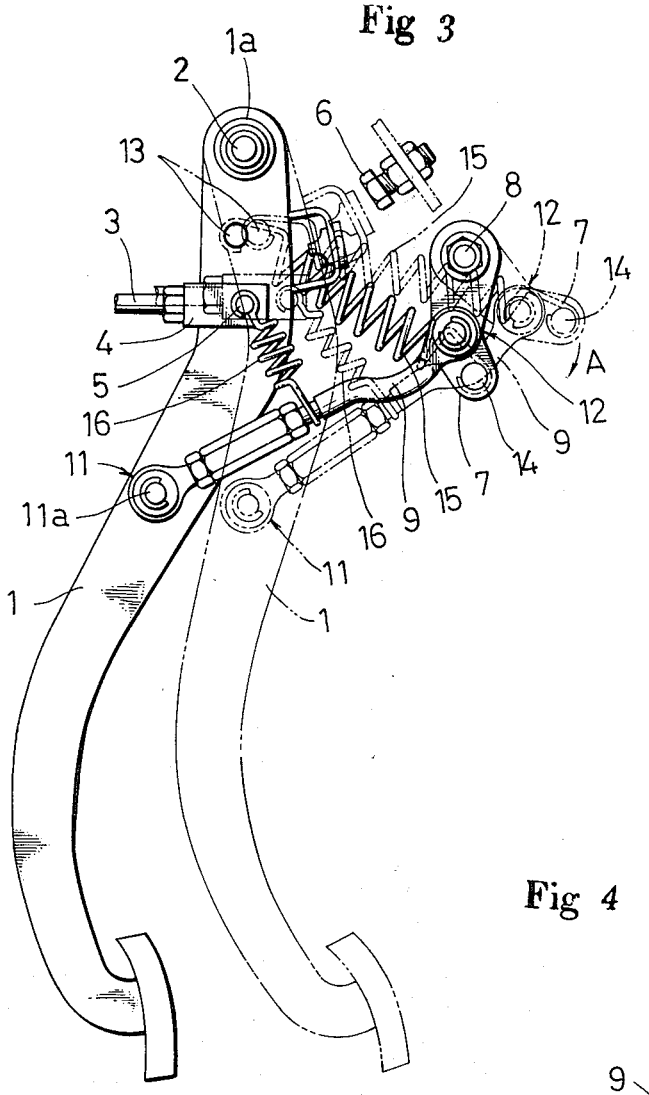
FIG. 3 is a front elevational view of the clutch pedal illustrating operation of the device according to the present invention.

In operation, the clutch pedal 1 is worked to be rotated along the shaft 2, and the arm 7 is rotated through the rod 9 in the direction of the arrow A as hereinabove described, so that the clutch pedal 1 reaches the turnover point as shown in phantom lines in FIG. 3.

After the clutch pedal 1 passes through the turnover point, the arm 7 acts reversely upon the clutch pedal 1 through the rod 9 to push the clutch pedal 1 forwardly in the direction to which it is worked. Namely, after going past the turnover point, the clutch pedal 1 is subjected to auxiliary force from the tension spring 15 to move into the position as shown in solid lines in FIG. 3.

Figure 4:
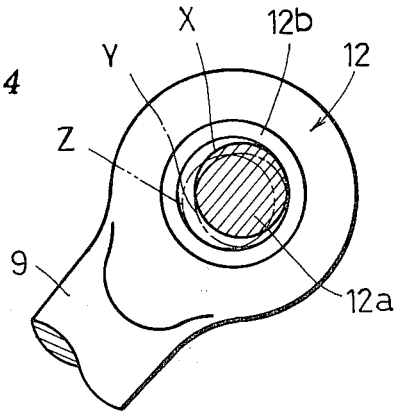
FIG. 4 is an enlarged partially fragmentary top plan view of the rod in either end in which the clearance between the pin and the bush is exaggeratedly illustrated for easy understanding of the connecting portion.
Figure 4:
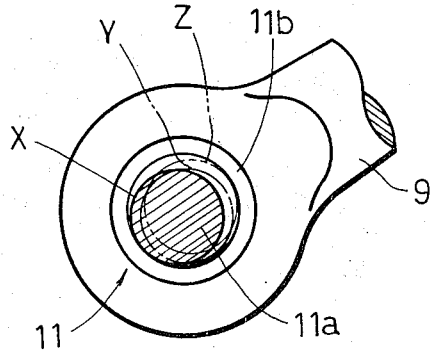

Thus, the force of the tension spring 15 acting on the clutch pedal 1 changes its direction at the turnover point as shown in phantom lines. Consequently, the force acting on the members 11 and 12 connecting the rod 9 with the pedal 1 and the arm 7 also changes its direction at the turnover point. FIG. 4 shows enlarged views of the connecting members 11 and 12 which are exaggeratedly illustrated for the purpose of each understanding of the conditions thereof. Between each of the pins 11*a* and 12*a* and the bushes 11*b* and 12*b*, there is a clearance for facilitating relative rotation thereof and/or defined by abrasion of the bushes 11*b* and 12*b*, and in FIG. 4, the clearances are illustrated in an extremely enlarged fashion for easy comprehension of the force acting on the connecting members 11 and 12.

When the force acting on the connecting members 11 and 12 changes its direction as hereinabove described, the pins 11*a* and 12*a* move relative to the rod 9 within the clearances from the positions shown by solid lines X to the positions shown by two-dot chain lines Z. Supposing that the pins 11*a*a and 12*a* move from the positions shown by the solid lines X directly to those shown by the two-dot chain lines Z relatively to the rod 9, there will be generated a knocking sound between the rod 9 and the pins 11*a* and 12*a*. In addition, the impact of each of the pins 11*a* and 12*a* upon the rod 9 will be transmitted to the clutch pedal 1 to impair pedal feeling.

However, in the embodiment of the present invention, the tension spring 16 is provided between the middle portion of the rod 9 and the clevis pin 5 of the clutch pedal 1 to apply tensile force substantially perpendicularly to the axis of the rod 9 when the clutch pedal 1 is in the turnover point as shown by phantom lines in FIG. 3 as hereinabove described. Therefore, the tensile force of the tension spring 16 acts equally upon the two connecting members 11 and 12. By virtue of this, the pins 11*a* and 12*a* move relatively to the rod 9 from the position shown by the solid lines X to those shown by the two-dot chain lines Z through positions shown by one-dot chain lines Y in FIG. 3. Namely, the pins 11*a* and 12*a* move relatively to the rod 9 along the bushes 11*b* and 12*b* continuously keeping in contact with the inner surfaces thereof to prevent generation of the aforementioned knocking sound and a bad influence to the pedal feeling.

It is again to be noted that the displacement between the pins 11*a* and 12*a* and the rod 9 is extremely exaggerated in FIG. 4, and through the pins 11*a* and 12*a* and the rod 9 are displaced relatively to each other, it is described in this specification on the supposition that the pins 11*a* and 12*a* alone move along the rod 9 while the rod 9 is kept stationary, for the convenience of explanation.

While the invention has been described with reference to a preferred embodiment thereof, it is to be understood that modification or variation may be easily made without departing from the scope of this invention which is defined by the appended claims.

What is claimed is:

1. A device for turning over a clutch pedal comprising an arm for turning said clutch pedal over, a rod connecting said arm to said clutch pedal for joint rotation upon working of said clutch pedal and a tension spring connected to said arm and said clutch pedal, the direction of force of said tension spring acting on said clutch pedal for returning the same to its initial position being changed to assist forward movement of said clutch pedal upon movement of said clutch pedal to a predetermined position, said device further including a biasing means connected to said rod for applying lateral force thereto.

2. The invention as defined in claim 1 wherein said biasing means for applying lateral force to said rod is a coiled spring provided between said clutch pedal and said rod.

3. The invention as defined in claim 2 wherein one end of said coiled spring is mounted to substantially intermediate portion of said rod, and said coiled spring becomes substantially perpendicular to said rod at said predetermined position in which said direction of force of said tension spring acting on said clutch pedal is changed.

* * * * *

UNITED STATES PATENT AND TRADEMARK OFFICE

CERTIFICATE OF CORRECTION

PATENT NO. : 4,319,497

DATED : March 16, 1982

INVENTOR(S) : Hiroaki Shinto et. al.

It is certified that error appears in the above—identified patent and that said Letters Patent is hereby corrected as shown below:

On the title page correct the Assignee to read:

[73] -- Assignee: TOYOTA JIDOSHA KOGYO KABUSHIKI KAISHA, Aichi-ken, Japan--

Signed and Sealed this

*Twenty-seventh* Day of *July 1982*

[SEAL]

*Attest:*

GERALD J. MOSSINGHOFF

*Attesting Officer*

*Commissioner of Patents and Trademarks*